US010187950B2

(12) United States Patent
Yan et al.

(10) Patent No.: US 10,187,950 B2
(45) **Date of Patent: *Jan. 22, 2019**

(54) ADJUSTING COLOR TEMPERATURE IN A DIMMABLE LED LIGHTING SYSTEM

(71) Applicant: DIALOG SEMICONDUCTOR INC., Campbell, CA (US)

(72) Inventors: Liang Yan, Milpitas, CA (US); Junjie Zheng, Santa Clara, CA (US)

(73) Assignee: DIALOG SEMICONDUCTOR INC., Campbell, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/838,293

(22) Filed: Dec. 11, 2017

(65) Prior Publication Data

US 2018/0103523 A1 Apr. 12, 2018

Related U.S. Application Data

(63) Continuation of application No. 13/750,945, filed on Jan. 25, 2013, now Pat. No. 9,844,113.

(51) Int. Cl.
*H05B 33/08* (2006.01)

(52) U.S. Cl.
CPC ..... *H05B 33/0857* (2013.01); *H05B 33/0824* (2013.01); *H05B 33/0827* (2013.01); *H05B 33/0845* (2013.01)

(58) Field of Classification Search
CPC ..... H05B 33/0815; H05B 33/0818; H05B 37/029; H05B 37/02; H05B 33/0803
USPC ..... 315/122, 291, 292, 185 R, 312, 307
See application file for complete search history.

(56) References Cited

U.S. PATENT DOCUMENTS

| | | | |
|---|---|---|---|
| 6,577,512 | B2 | 6/2003 | Tripathi et al. |
| 6,586,890 | B2 | 7/2003 | Min et al. |
| 7,256,554 | B2 | 8/2007 | Lys |
| 7,262,559 | B2 | 8/2007 | Tripathi et al. |
| 7,358,679 | B2 | 4/2008 | Lys et al. |
| 7,737,643 | B2 | 6/2010 | Lys |
| 7,777,704 | B2 | 8/2010 | S et al. |

(Continued)

FOREIGN PATENT DOCUMENTS

| | | | |
|---|---|---|---|
| DE | 102010055296 | A1 | 6/2012 |
| JP | 2009-009817 | A | 1/2009 |

(Continued)

OTHER PUBLICATIONS

Second Chinese Office Action dated Apr. 5, 2016 from corresponding Chinese Application No. 2014100050833.

(Continued)

*Primary Examiner* — Douglas W Owens
*Assistant Examiner* — Syed M Kaiser
(74) *Attorney, Agent, or Firm* — Haynes and Boone, LLP

(57) ABSTRACT

A LED lighting system, such as a dimmable LED lamp, that may simulate the performance of an incandescent bulb. LED strings of different colors may be connected to the output of a single LED driver that regulates an overall intensity of light produced by the LED lighting system. The color of the LED lighting system may be controlled by circuitry, such as one or more switches, that allocates current between the LED strings to change the color temperature of light emitted by the LED lighting system as the light intensity changes.

16 Claims, 6 Drawing Sheets

(56) References Cited

U.S. PATENT DOCUMENTS 8,248,145 B2 * 8/2012 Melanson ..... H02M 3/158 323/222
8,456,109 B1 * 6/2013 Wray ..... H05B 33/0824 315/209 R
9,184,660 B2 11/2015 Sagneri et al.
9,318,958 B2 * 4/2016 Sagneri ..... H02M 3/335
9,844,113 B2 * 12/2017 Yan ..... H05B 33/0857
2007/0040516 A1 * 2/2007 Chen ..... H05B 39/045 315/291
2007/0182347 A1 * 8/2007 Shteynberg ..... H05B 33/0815 315/312
2008/0224633 A1 * 9/2008 Melanson ..... H05B 33/0809 315/292
2010/0026191 A1 * 2/2010 Radermacher ..... H05B 33/0815 315/149
2010/0060175 A1 * 3/2010 Lethellier ..... H05B 33/0815 315/164
2011/0115407 A1 * 5/2011 Wibben ..... H05B 33/0815 315/294
2011/0193489 A1 * 8/2011 Moss ..... H05B 33/0818 315/210
2011/0291585 A1 * 12/2011 Foo ..... H05B 33/0815 315/291
2012/0038292 A1 * 2/2012 Kuo ..... H05B 33/0818 315/297
2012/0069606 A1 * 3/2012 Sagneri ..... H02M 3/158 363/21.02
2012/0081009 A1 * 4/2012 Shteynberg ..... H05B 33/083 315/122
2012/0153834 A1 * 6/2012 Moss ..... H05B 33/0815 315/122
2013/0193877 A1 * 8/2013 Kuo ..... H05B 33/0815 315/307
2013/0193879 A1 * 8/2013 Sadwick ..... H05B 33/0818 315/307
2013/0229119 A1 * 9/2013 Korobov ..... H05B 33/0818 315/185 R
2013/0278145 A1 * 10/2013 Lin ..... H05B 33/0851 315/122

FOREIGN PATENT DOCUMENTS

JP 2011-204625 A 10/2011
JP 2012-174649 A 9/2012
JP 2012-204258 A 10/2012
JP 2012-221770 A 11/2012
WO WO 2008/041153 4/2008

OTHER PUBLICATIONS

European Search Report for Application No. EP13194965.3, dated Apr. 10, 2014 (7 pages).
Japan Office Action, Japanese Application No. 2014-010594, dated Nov. 4, 2013 (8 pages).

* cited by examiner

ADJUSTING COLOR TEMPERATURE IN A DIMMABLE LED LIGHTING SYSTEM

CROSS-REFERENCE TO RELATED APPLICATIONS

This application is a continuation of U.S. patent application Ser. No. 13/750,945, filed Jan. 25, 2013.

BACKGROUND

Field of Technology

Embodiments disclosed herein relate to light emitting diode (LED) lighting systems, and more specifically to adjusting the output light intensity and color temperature of dimmable LED lamps.

Description of the Related Art

LEDs are being adopted in a wide variety of electronics applications, for example, architectural lighting, automotive head and tail lights, backlights for liquid crystal display devices, flashlights, etc. Compared to conventional lighting source such as incandescent lamps and fluorescent lamps, LEDs have significant advantages, including higher efficiency, better directionality, better color stability, higher reliability, longer life, and smaller size.

Today, there are many LED based lamps available that are designed to be direct replacement of incandescent bulbs and can be dimmed by a dimmer switch. When incandescent bulbs are dimmed, the filament temperature decreases, causing the emitted light to appear warmer as its color temperature changes from white, to yellow, and then finally to orange. On the other hand, LEDs typically do not change color temperature as they are dimmed and produce the same color light (e.g. white light) even when the light intensity is decreased. Some conventional LED lamps attempt to mimic the light output of incandescent bulbs by mixing different color LEDs and adjusting the brightness of the different colors as the dimming level increases. However, these conventional LED lamps use complex circuitry for controlling different LED colors, which results in LED lamps that are expensive to produce, are prone to failure, and are not commercially viable.

SUMMARY

Embodiments disclosed herein describe a LED lighting system, such as a dimmable LED lamp, that may simulate the performance of an incandescent bulb without a high amount of cost. In one embodiment, a LED lighting system comprises a LED driver configured to generate a regulated current at an output of the LED driver. A first LED string is coupled to the output of the LED driver and is configured to emit light of a first color temperature (e.g. red) based on a first portion of the regulated current flowing through the first LED string. A second LED string is coupled to the output of the LED driver and is configured to emit light of a second color temperature (e.g. white) based on a second portion of the regulated current flowing through the second LED string, the second color temperature being different than the first color temperature. The LED lighting system also includes circuitry configured to control allocation of the regulated current between the first portion of the regulated current flowing through the first LED string and the second portion of the regulated current flowing through the second LED string responsive to a signal indicative of a desired brightness level (e.g. from a dimmer switch).

In one embodiment, the circuitry includes a controller circuit configured to receive the signal indicative of the desired brightness level and to generate at least one switch control signal responsive to the signal indicative of the desired brightness level. The circuitry also includes a first switch coupled in series with the first LED string, wherein a duty cycle of ON and OFF times of the first switch is responsive to a first switch control signal of the at least one switch control signals. The allocation of the regulated current between the first portion of the regulated current flowing through the first LED string and the second portion of the regulated current flowing through the second LED string is responsive to the duty cycle of the first switch.

In one embodiment, a method of operation in a LED lighting system is disclosed. A signal indicative of a desired brightness level is received. A regulated current is generated at an output of a LED driver, wherein a first LED string is configured to emit light of a first color temperature based on a first portion of the regulated current flowing through the first LED string and the second LED string is configured to emit a light of a second color temperature based on a second portion of the regulated current flowing through the second LED string, the second color temperature being different than the first color temperature. At least one control signal is generated responsive to the desired brightness level. The regulated current is allocated between the first portion of the regulated current flowing through the first LED string and the second portion of the regulated current flowing through the second LED string responsive to the at least one control signal.

The features and advantages described in the specification are not all inclusive and, in particular, many additional features and advantages will be apparent to one of ordinary skill in the art in view of the drawings and specification. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments disclosed herein can be readily understood by considering the following detailed description in conjunction with the accompanying drawings.

DETAILED DESCRIPTION OF EMBODIMENTS

The Figures (FIG.) and the following description relate to various embodiments by way of illustration only. It should be noted that from the following discussion, alternative embodiments of the structures and methods disclosed herein will be readily recognized as viable alternatives that may be employed without departing from the principles discussed herein.

Reference will now be made in detail to several embodiments, examples of which are illustrated in the accompanying figures. It is noted that wherever practicable similar or like reference numbers may be used in the figures and may indicate similar or like functionality. The figures depict various embodiments for purposes of illustration only. One skilled in the art will readily recognize from the following description that alternative embodiments of the structures and methods illustrated herein may be employed without departing from the principles described herein.

Embodiments disclosed herein describe a LED lighting system, such as a dimmable LED lamp, that can simulate the changes in color temperature of an incandescent bulb without high cost. In one embodiment, LED strings of different colors may be coupled to the output of a single LED driver that regulates an overall intensity of light produced by the LED lighting system. Circuitry, such as a LED controller and one or more switches, are used to allocate current driven by the LED driver between the LED strings to change the overall color temperature of light emitted by of the LED lighting system as the light intensity changes.

Figure 1:
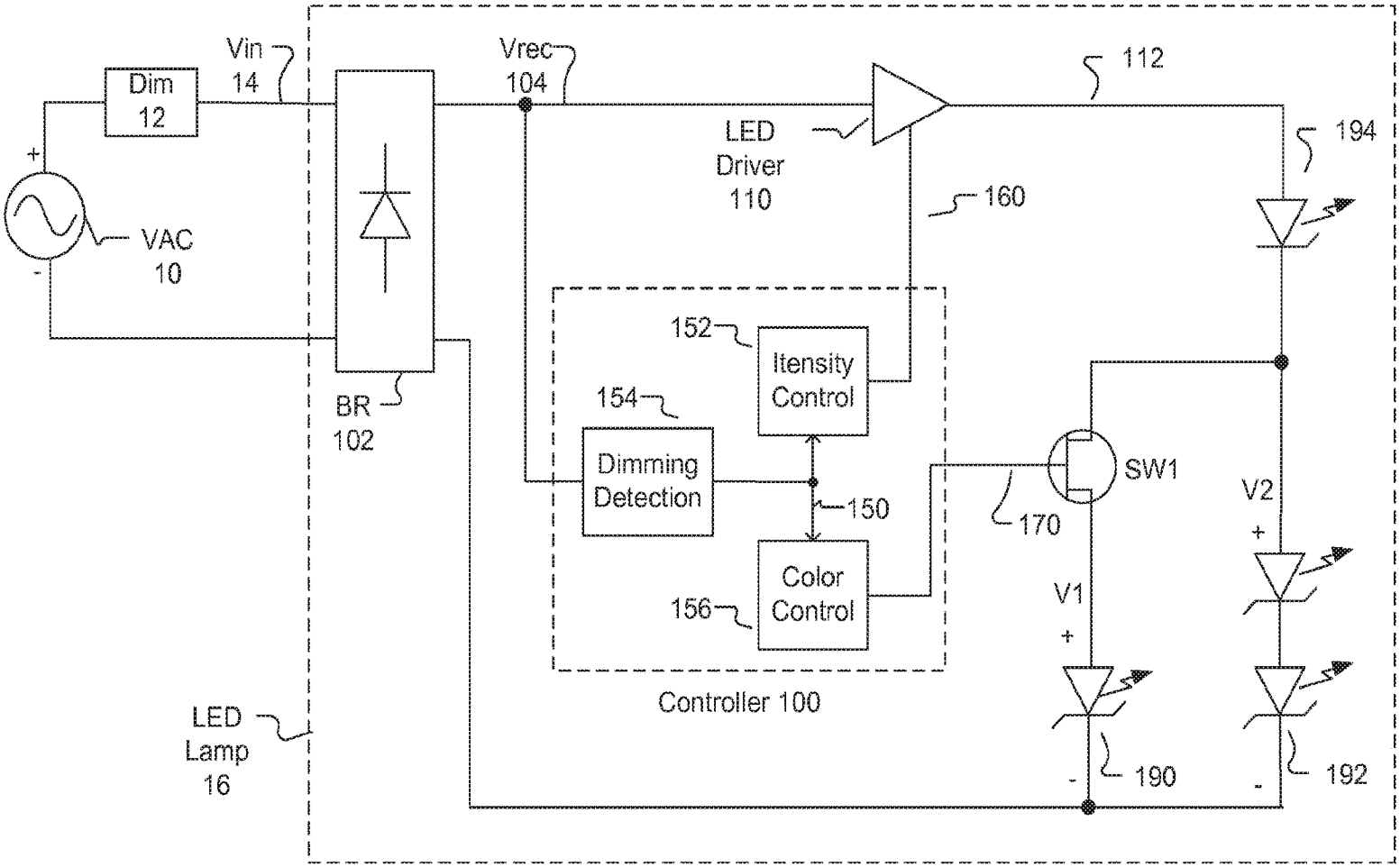
FIG. 1 is a LED lighting system, according to one embodiment.

FIG. 1 is a LED lighting system, according to one embodiment. The LED lighting system includes an AC voltage source 10, a dimmer switch 12, and a LED lamp 16. The dimmer switch 12 receives an AC voltage from the AC voltage source 10 and adjusts the AC voltage to generate an input voltage 14 for the LED lamp 16. The dimmer switch 12 has an adjustable dimming level. The dimmer switch controls a shape and/or magnitude of the input voltage 14 according to the adjustable dimming level such that the shape and/or magnitude of the input voltage 14 represents a desired brightness level of the LED lamp 16. The dimmer switch 12 may use leading edge or trailing edge phase-angle switching or other techniques to produce the input voltage 14. Some examples of dimmer switches are manually controlled dimmer switches and light sensors that automatically adjust the dimming level as the amount of ambient light changes.

The LED lamp 16 receives the input voltage 14 and converts the energy of input voltage 14 into visible light. To mimic the performance of an incandescent bulb, the intensity and color temperature of the light varies as the desired dimming level changes. In one embodiment, the LED lamp 16 is a light fixture that can be used as a direct replacement for an incandescent or fluorescent light bulb. As shown, the LED lamp 16 includes a bridge rectifier 102, a single LED driver 110, a lamp controller 100, three LED strings 190, 192, 194, and a switch SWI.

The bridge rectifier 102 receives the input voltage 14 and rectifies the input voltage 14 to generate a rectified input voltage signal 104. Similar to the input voltage 14, the shape and I or magnitude of the rectified input voltage signal 104 also includes information about the desired brightness level of the LED lamp 16, which corresponds to the desired dimming level set by the dimmer switch 12.

The LED driver 110 receives the rectified input voltage signal 104 and generates a regulated current 112 at the output of the LED driver 110. The LED driver 110 controls a level of the regulated current 112 in accordance with a driver control signal 160 generated by the lamp controller 100. In one embodiment, the LED driver 110 is a switching power regulator that converts the rectified input voltage signal 102 into the regulated current 112. For example, the LED driver 110 may include a boost stage connected to the rectified input voltage signal 102 and a flyback stage connected to the output of the boost stage to regulate the current through the LED strings. The duty cycle (i.e. ON and OFF times) of a switch in the flyback stage is controlled by the driver control signal 160 to produce the regulated current 112. Alternatively, the LED driver 110 may include only a flyback stage without a boost stage.

LED strings 190, 192, and 194 are all coupled to the output of the LED driver 110. LED string 194 is coupled between the output of the LED driver 110 and the two LED strings 190 and 192. Both LED strings 190 and 192 are coupled to the output of the LED driver 110 through LED string 194. Because all of the LED strings 190, 192 and 194 are coupled to and driven by a single output of a single LED driver 110, the cost of the LED lamp 16 can be reduced while still maintaining the ability to control the intensity and color of color produced by the LED lamp 16.

As shown, LED string 190 includes one LED, LED string 192 includes two LEDs, and LED string 194 includes one LED. In other embodiments, the LED strings may have a different number of LEDs than that shown in FIG. 1.

LED string 192 is connected in parallel with switch SW1 and LED string 190. The branching configuration of LED string 190 and 192 results in a sharing of the regulated current 112 driven from LED driver 110 such that a portion of the regulated current 112 flows through LED string 192 and the remaining portion of the regulated current 112 flows through LED string 190. In one embodiment, the regulated current 112 is switched back and forth between LED string 190 and LED string 192 by switch SW1, and the portion of the regulated current 112 through a given LED string refers to an average amount of the regulated current 112 that is switched through a LED string over time. In some embodiments, a portion of the regulated current 112 may include an entirety of the regulated current 112 or a less than all of the regulated current 112.

A switch SWI is connected in series with LED string 190 but is not in series with LED string 192. When switch SWI is switched off, all of the regulated current 112 flows through LED string 192. When switch SWI is switched on, substantially all of the regulated current 112 is diverted away from LED string 192 and flows through LED string 190. This is because the voltage V2 across LED string 192 becomes equal to the forward voltage drop V I across the single LED of LED string 190 (assuming no voltage drop across switch SWI), which is not sufficient to turn on the LEDs of LED string 192.

The LED strings also emit different color temperatures of light. LED strings 194 and 192 emit white light and LED string 190 emits red light, which has a lower average color temperature than white light. LEDs are also current controlled devices and the overall color temperature produced by the LED lamp 16 can be adjusted by controlling the duty cycle of switch SWI to adjust the allocation of regulated current 112 between LED string 190 and LED string 192. Serial switch SWI is thus used to maintain control over the color temperature of the LED lamp 16 without the need for multiple LED drivers 110, which reduces the cost of the LED lamp 16. In other embodiments, the LED strings may emit light with temperature colors other than red and white.

Lamp controller 100 includes logic that controls the operation of the LED lamp 16, and may be, for example, an integrated circuit (IC) with pins for connecting to other components within the LED lamp 16. Lamp controller 100 includes a dimming detection module 154, an intensity control module 152 and a color control module 156. Each of the modules 152, 154, 156 may be implemented by hardware circuitry, by software instructions executable by a processor or a microcontroller, or by a mix of hardware circuitry and software instructions.

Dimming detection module 154 receives the rectified input voltage signal 104 and detects a desired brightness level from the magnitude and I or shape of the rectified input voltage 104. The desired brightness level represents the dimming level of the dimmer switch 12. The dimming detection module 154 then generates a target current signal 150 that represents a target current level. Higher desired brightness levels result in higher target current levels and brighter light output. Lower desired brightness levels result in lower target current levels and darker light output.

Intensity control module 152 receives the target current signal 150 and generates driver control signal 160, which the LED driver 110 uses to regulate the level of current 112 at the output of the LED driver 110. The level of the current 112 directly affects the overall intensity of light emitted by the LED lamp 16. In embodiments where the LED driver 110 is a switching power regulator, the intensity control module 152 may vary the duty cycle of the driver control signal 160 using pulse width modulation (PWM) or pulse frequency modulation (PFM) or a combination of PWM and PFM to regulate the amount of current 112 output by the LED driver 110.

Color control module 156 receives the target current signal 150 and uses the target current level to control the color temperature of light emitted by the LED lamp 16. More specifically, the color control module 150 generates a switch control signal 170 that controls the duty cycle of the amount of time during which switch SW1 is turned ON or OFF, which in turn controls the allocation of regulated current 112 between LED strings 190 and 192, respectively. The color control module 150 may use PWM or PFM or a combination of PWM and PFM in controlling the duty cycle of the switch SW1.

When the target current level is high, color control module 156 decreases the duty cycle of switch SW1 to increase the percentage of the regulated current 112 that is supplied to white LED string 192. The LED lamp 16 thus produces a whitish light because most of the regulated current 112 passes through white LED string 192. When the target current level is low, dimming color controller 100 increases the duty cycle of switch SW1 to increase the percentage of the regulated current 112 that is diverted to red LED string 190. The LED lamp 16 thus produces light with a reddish hue because most of the regulated current 112 passes through red LED string 190.

In other words, through duty cycle control of switch SW1, the color control module 156 and switch SW1 control allocation of the regulated current 112 between the first LED string and the second LED string, i.e. the amount of regulated current 112 flowing through LED string 190 relative to the amount of the regulated current 112 flowing through LED string 192. As the desired brightness level decreases and the regulated current 112 decreases to dim the LED lamp 16, color control module 156 also adjusts the color temperature of the LED lamp 16 to by steering more current to LED string 190 to simulate the color of an incandescent bulb.

In other embodiments, the colors of the LEDs in LED strings 190 and 192 may be reversed so that, instead of decreasing in color temperature, the color temperature of the LED lamp 16 increases as the desired brightness level decreases.

Figure 2:
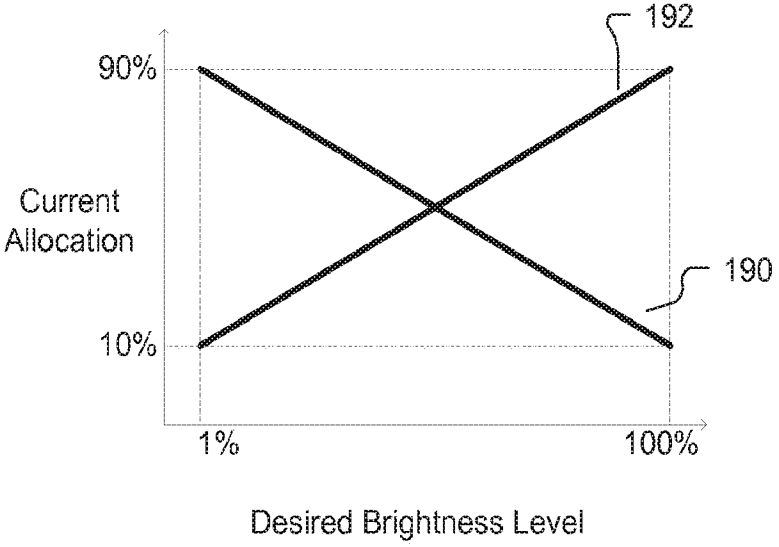
FIG. 2 is a graph illustrating the allocation of regulated current between the LED strings of a LED lighting system from FIG. 1, according to one embodiment.

FIG. 2 is a graph illustrating the allocation of regulated current between the LED strings of a LED lighting system from FIG. 1, according to one embodiment. The X axis of the graph represents the desired brightness level of the dimmer switch 12. The Y axis represents the allocation of the regulated current between the LED strings.

When the desired brightness level is at 100%, 90% of the regulated current 112 flows through white LED string 192 and 10% of the current flows through red LED string 190. As the desired brightness level decreases towards 1%, the allocation of regulated current 112 to red LED string 190 increases while the allocation of regulated current 112 to white LED string 192 decreases. This allocation of regulated current 112 results in a light output that becomes increasingly reddish as the desired brightness level decreases.

Figure 3:
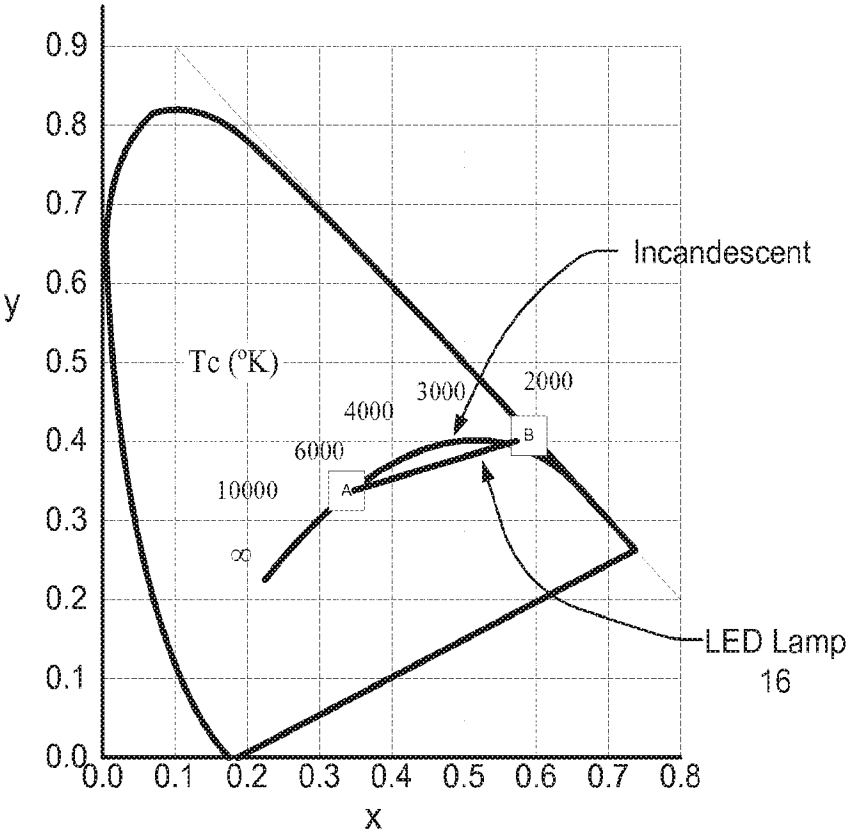
FIG. 3 is a chromacity diagram for the LED lighting system of FIG. 1, according to an embodiment.

FIG. 3 is a chromacity diagram for the LED lighting system of FIG. 1, according to an embodiment. The chromacity diagram includes the color response for both a conventional incandescent lamp and the LED lamp 16. Incandescent lamps change from color temperature A to color temperature B when dimmed. To mimic the effect of an incandescent lamp, the allocation of current between LED strings 192 and 194 can be tuned such that the color temperature of LED lamp 16 also changes from color temperature A to color temperature B when dimmed. This is in contrast to conventional LED lamps that stay at color temperature A even when dimmed.

As shown in FIG. 3, the color response of the LED lamp 16 is approximately linear and may not exactly follow the non-linear color response of the incandescent lamp. In other embodiments, the color response of the LED lamp 16 can be more closely matched to that of an incandescent lamp by using three parallel LED strings of different colors (e.g., red, green, and blue), and controlling the current through each LED string with a different switch in a non-linear manner that more closely mimics the color response of the incandescent lamp.

Figure 4:
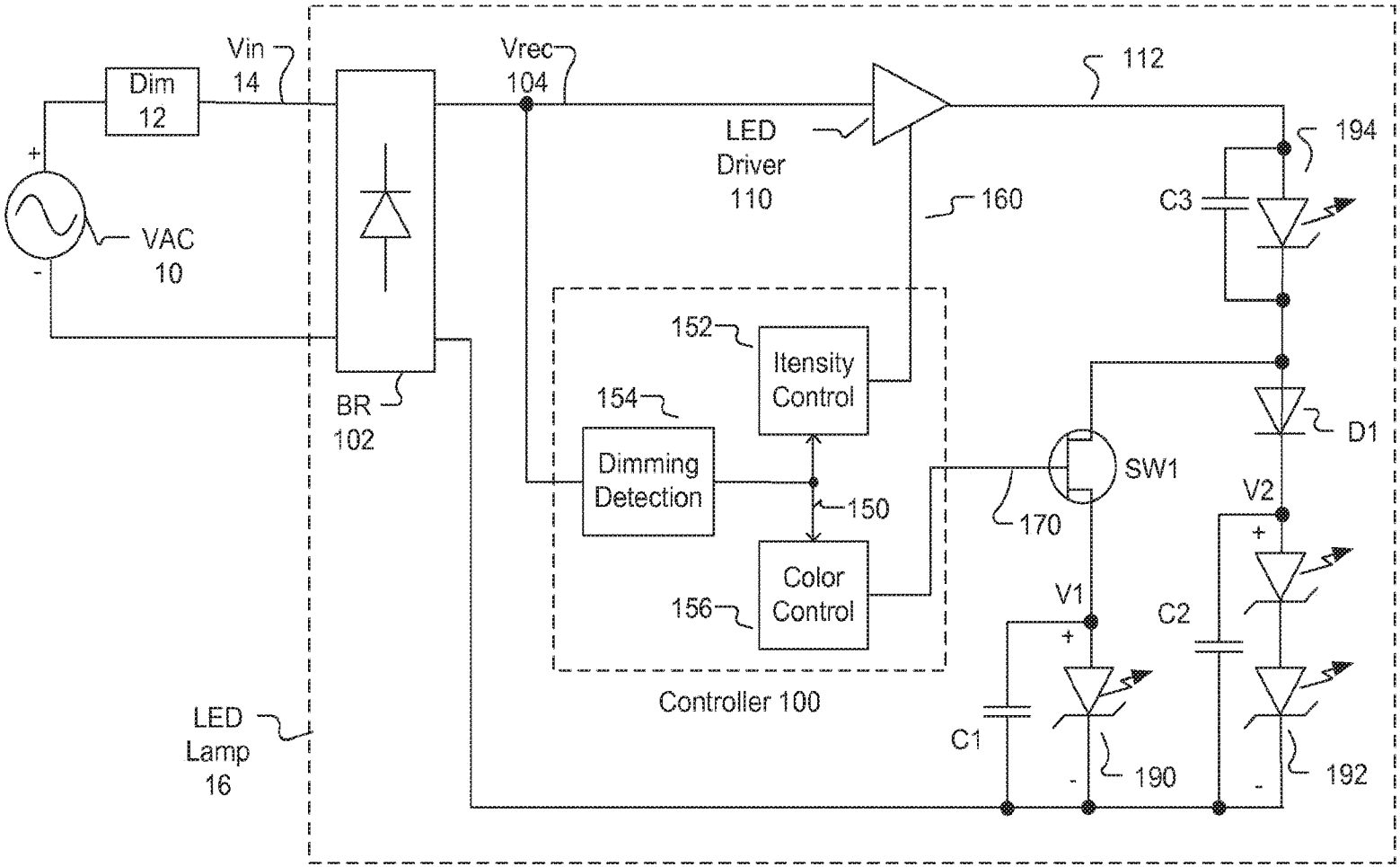
FIG. 4 is a LED lighting system, according to another embodiment.

FIG. 4 is a LED lighting system, according to another embodiment. The LED lighting system of FIG. 4 is substantially similar to the LED lighting system of FIG. 1, but now the LED lamp 16 includes three capacitors C 1 C2 and C3. Capacitor C 1 is connected in parallel with LED string 190. Capacitor C2 is connected in parallel with LED string 192. Capacitor C3 is connected in parallel with LED string 194. The capacitors C 1, C2, C3 minimize voltage transients that occur when the switch SWI transitions from an ON state to an OFF state, as well as from the OFF state to the ON state by providing a bypass path to filter out the voltage transients. LED lamp 16 also includes a diode D 1 connected in series with LED string 192. Anode of diode D 1 is connected to LED string 194, and cathode of diode D 1 is connected to LED string 192. Diode D 1 prevents the charge stored in C2 from discharging through LED string 190 when switch SWI is switched ON.

Figure 5:
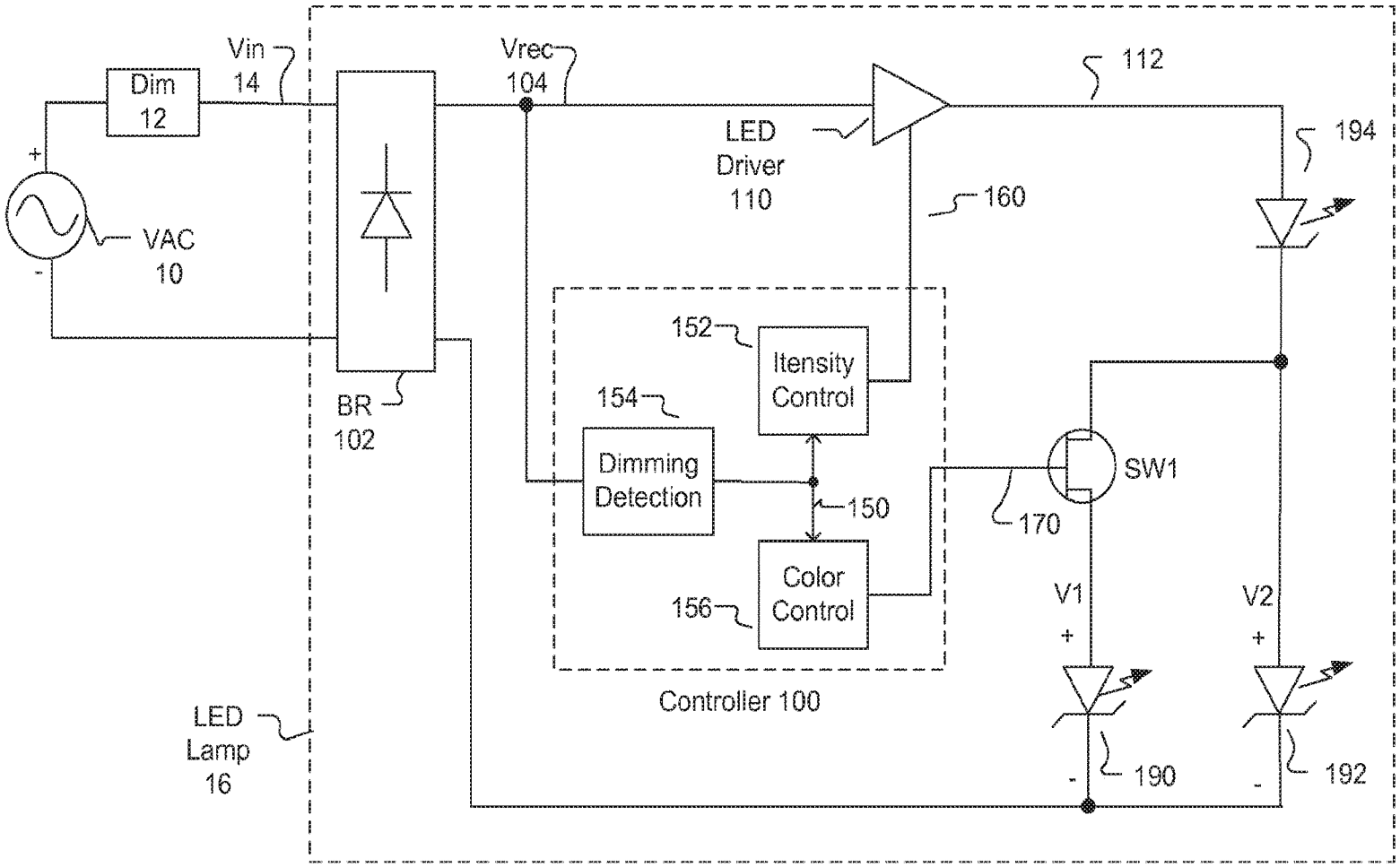
FIG. 5 is a LED lighting system, according to yet another embodiment.

FIG. 5 is a LED lighting system, according to yet another embodiment. The LED lighting system of FIG. 4 is substantially similar to the LED lighting system of FIG. 1, except that LED string 192 only includes a single LED. As a result, when switch SWI is turned ON, the LED strings 190 and 192 split the regulated current 112, unlike the embodiment of FIG. 1 where the LED string 192 is turned off when switch SWI is on.

Half of the regulated current 112 flows through LED string 190, and the other half of the regulated current 112 flows through LED string 192. This is because voltage V I and V2 are both equal to the forward voltage drop across a single LED, which enables both LED string 190 and 192 to be turned on at the same time. In other embodiments, LED strings 190 and 192 may each have more than one LED, so long as the number of LEDs in both strings 190 and 192 remains the same.

Color control module 156 still controls the duty cycle of switch control signal 170 and switch SW1 to control allocation of current between red LED string 190 and white LED string 192. However, the color response of the LED lamp 16 of FIG. 5 may be different than the color response of the LED lamp 16 of FIG. 1. Because both LED strings 190 and 192 share the regulated current when switch SW1 is ON, the decrease in the overall color temperature for LED lamp 16 of FIG. 5 may not be as fast as that of LED lamp 16 in FIG. 1.

Figure 6:
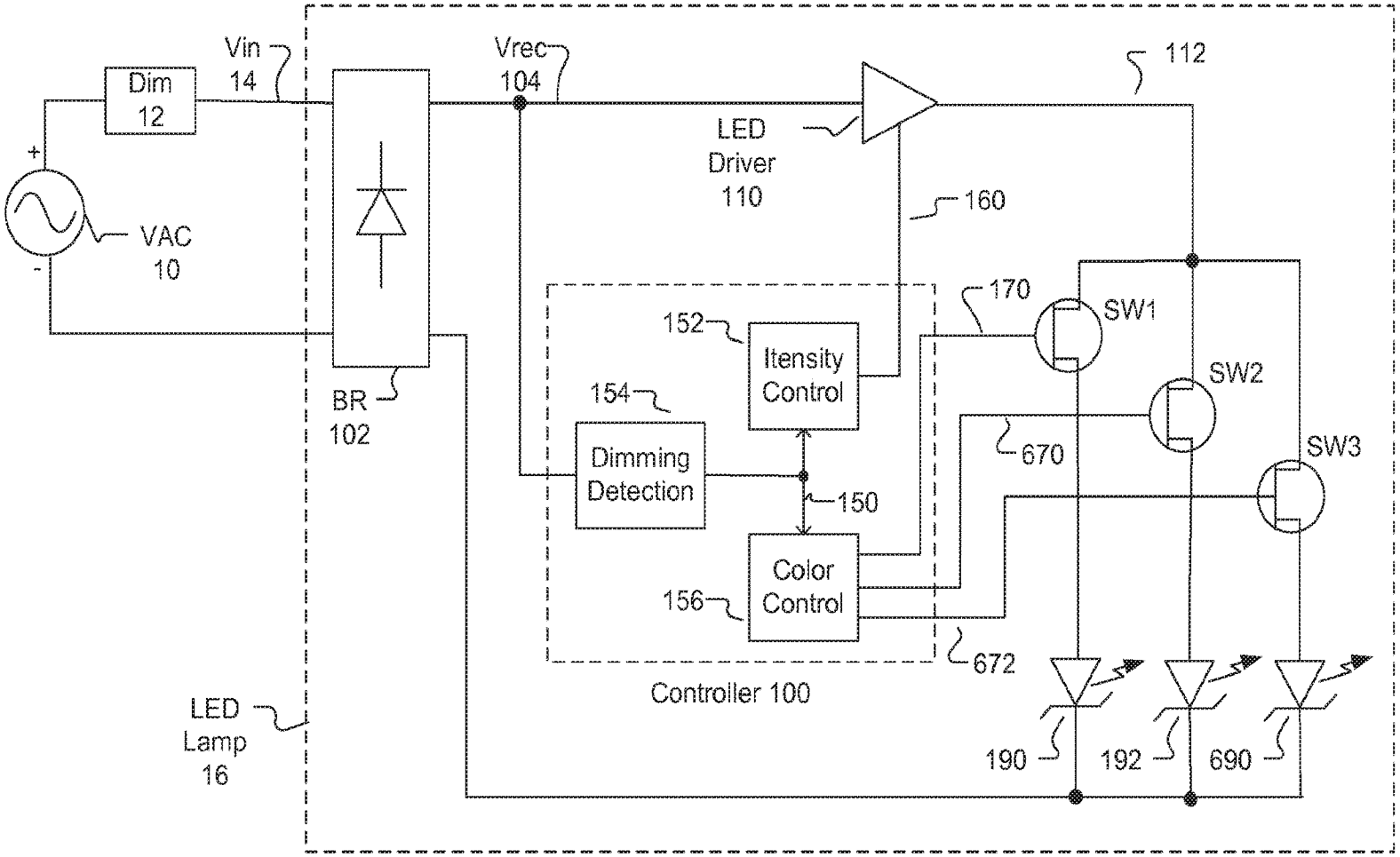
FIG. 6 is a LED lighting system, according to a further embodiment.

FIG. 6 is a LED lighting system, according to a further embodiment. The LED lighting system of FIG. 6 is similar to the LED lighting system of FIG. 1, except that there are now three LED strings 190, 192, and 690 connected in parallel to each other. Each of the LED strings 190, 192, and 690 may emit a different color of light. For example, LED string 190 may emit red light, LED string 192 may emit green light, and LED string 690 may emit blue light.

Each of the LED strings is connected in series with a different switch SW that controls a portion of the regulated current 112 that passes through the LED string. Switch SW1 is coupled in series to LED string 190, switch SW2 is coupled in series to LED string 192, and switch SW3 is coupled in series to LED string 690. Each of the switches SW1, SW2, SW3 is also directly coupled to the output of the LED driver 110.

The color control module 156 also generates different switch control signals 170, 670, 672 to control the duty cycle of the switches SW1, SW2, SW3, respectively. Switch control signal 170 controls the on/off duty cycle of switch SW1, switch control signal 670 controls the on/off duty cycle of switch SW2, and switch control signal 672 controls the on/off duty cycle of switch SW3.

The use of three different color LED strings and independent control of current through each of the LED strings 170, 670, 672 with the switches SW1, SW2, SW3 allows more versatile control over the color of light emitted by the LED lamp 16 because the amount of three different color lights (e.g., red, green, and blue) can be adjusted depending on the overall color of the LED lamp 104 that needs to be generated to mimic an incandescent lamp. For example, when the desired brightness is high, the duty cycle of all three switches SW can be equal so that the output light is white. As the desired brightness level decreases, the color control module 156 can adjust the duty cycle of the switches SW so that the color response of the LED lamp 16 matches the color response of an incandescent bulb as shown in FIG. 3.

In one embodiment, the switches SW1, SW2 and/or SW3 may referred to as current allocation control circuits because they control the amount of current that flows down each branch of LED strings 190, 192 and 690 by blocking or allowing current to flow through their respective LED strings 190, 192 and 690.

Upon reading this disclosure, those of skill in the art will appreciate still additional alternative designs for adjusting the color output in a dimmable LED lighting system. Thus, while particular embodiments and applications have been illustrated and described, it is to be understood that the embodiments discussed herein are not limited to the precise construction and components disclosed herein and that various modifications, changes and variations which will be apparent to those skilled in the art may be made in the arrangement, operation and details of the method and apparatus disclosed herein without departing from the spirit and scope of the disclosure.

What is claimed is:

1. A light emitting diode (LED) controller for a switching power converter, comprising:

a dimming detection module configured to receive a rectified input voltage, to detect a desired brightness level from a magnitude and/or a shape of the rectified input voltage, and to thereby generate a target current level signal that varies responsive to a variation of the desired brightness level;

a regulator configured to regulate a cycling of a power switch to generate a regulated current at an output of the switching power converter responsive to the target current level signal; and circuitry configured to allocate the regulated current between a first portion of the regulated current flowing through a first LED string and a second portion of the regulated current flowing through a second LED string responsive to changes in the desired brightness level such that a light output from the first LED string and the second LED string increases in redness responsive to a decrease in the desired brightness level, the circuitry comprising:

a first switch coupled in series with the first LED string, wherein a duty cycle of ON and OFF times of the first switch is responsive to a first switch control signal; and a color control module configured to generate the first switch control signal responsive to the target current level signal.

2. The LED controller of claim 1, wherein a duty cycle of ON-times and OFF-times of the power switch is controlled responsive to the target current level signal.

3. The LED controller of claim 1, wherein the circuitry further comprises:

a second switch coupled in series with the second LED string, wherein a duty cycle of ON and OFF times of the second switch is responsive to a second switch control signal, wherein the color control module is configured to generate the second switch control signal responsive to the target current level signal.

4. The LED controller of claim 1, wherein substantially all of the regulated current flows through the first LED string when the first switch is ON.

5. The LED controller of claim 1, wherein the regulated current is split between the first LED string and the second LED string when the first switch is ON.

6. The LED controller of claim 1, wherein as the desired brightness level decreases, an overall color temperature of the light emitted by the first string and the light emitted by the second LED string decreases.

7. The LED controller of claim 1, wherein, as a level of the regulated current decreases, the first portion of the regulated current flowing through the first LED string increases relative to the second portion of the regulated current flowing through the second LED string.

8. A method of operation for a light emitting diode (LED) controller for a switching power converter, the method comprising:

detecting a desired brightness level from a magnitude and/or a shape of a rectified input voltage from a phase cut dimmer switch;

generating a target current level signal that varies responsive to a variation in the desired brightness level;

cycling a power switch to drive a regulated current through an output of the switching power converter; and controlling an allocation of the regulated current between a first LED string and a second LED string, the allocation of the regulated current being controlled such that an overall light emitted by the first LED string and the second LED string increases in redness responsive to a decrease in the desired brightness level.

9. The method of claim 8, further comprising controlling a duty cycle of ON-times and OFF-times of the power switch responsive to the target current level signal.

10. The method of claim 8, wherein a first color temperature of light emitted by the first LED string is lower than a second color temperature of light emitted by the second LED string.

11. The method of claim 10, wherein the first color temperature of emitted by the first LED string is substantially red and the second color temperature of light emitted by the second LED string is substantially white.

12. The method of claim 8, wherein controlling the allocation of the regulated current comprises:

generating at least one switch control signal responsive to the target current level signal; and controlling a duty cycle of ON times and OFF times of a first switch coupled in series with the first LED string.

13. The method of claim 12, wherein the controlling of the allocation of the regulated current further comprises:

controlling a duty cycle of ON times and OFF times of a second switch coupled in series with the second LED string.

14. The method of claim 12, wherein a number of LEDs in the first LED string is different than a number of LEDs in the second LED string, and wherein substantially all of the regulated current flows through the first LED string when the first switch is ON.

15. The method of claim 12, wherein a number of LEDs in the first LED string is equal to a number of LEDs in the second LED string, and wherein the regulated current is split between the first LED string and the second LED string when the first switch is ON.

16. The method of claim 12, wherein, as a level of the regulated current decreases, a first portion of the regulated current flowing through the first LED string increases relative to a second portion of the regulated current flowing through the second LED string.

* * * * *